US006889612B1

(12) United States Patent
Liaw et al.

(10) Patent No.: US 6,889,612 B1
(45) Date of Patent: May 10, 2005

(54) LONG-DISTANCE BLAST BANGER

(75) Inventors: Joey Liaw, I-Lan (TW); Kuei-Fu Fan, I-Lan (TW); Shi-Xing Chang, I-Lan (TW); Shu-Fang Chen, I-Lan (TW)

(73) Assignee: The 204th Arsenal, Material Production Center Armement Bureau, I-Lan (TW)

( * ) Notice: Subject to any disclaimer, the term of this patent is extended or adjusted under 35 U.S.C. 154(b) by 0 days.

(21) Appl. No.: 10/745,674

(22) Filed: Dec. 29, 2003

(51) Int. Cl.[7] ..... F42B 14/02

(52) U.S. Cl. ..... 102/477; 102/439; 102/502; 102/524; 102/346

(58) Field of Search ..... 102/439, 466, 102/467, 477, 502, 524, 346, 506

(56) References Cited

U.S. PATENT DOCUMENTS 3,074,344 A * 1/1963 Devaux ..... 102/454
3,120,186 A * 2/1964 Harvey ..... 102/439
3,349,707 A * 10/1967 Wortley, Jr. et al. ..... 102/346
3,416,401 A * 12/1968 Golbeck et al. ..... 89/1.3
5,235,915 A * 8/1993 Stevens ..... 102/439
6,257,146 B1 * 7/2001 Stonebraker ..... 102/346

FOREIGN PATENT DOCUMENTS

DE 29 03 286 * 8/1980 ..... 102/439
WO WO 91/02211 * 2/1991

* cited by examiner

*Primary Examiner*—Stephen M. Johnson
(74) *Attorney, Agent, or Firm*—Troxell Law Office, PLLC

(57) ABSTRACT

A long-distance blast banger including a cartridge loaded with a blast banger made up from plastic material. The blast banger encompasses a sound explosives cup and a delay cup. The sound explosives cup is loaded with a sound explosives agent having components including perchloryl potassium, magnesium powder and aluminum powder. A sufficient sound value is acquired through appropriate compacting of the sound explosives cup, and therefrom realizes uniform shattering of the cup into small fragments that are insufficient to cause injury. Furthermore, at least two helical grooves extending from a bottom to a top of the cartridge are defined on an inner wall thereof, and ear attachments are configured on a base of an outer wall of the blast banger so as to correspond with the helical grooves, thereby engendering a spinning stability effect during flight time of the blast banger, reducing wind resistance, and thus increasing flight range.

2 Claims, 3 Drawing Sheets

LONG-DISTANCE BLAST BANGER

BACKGROUND OF THE INVENTION (a) Field of the Invention

The present invention relates to a blast banger, and more particularly to structure of the long-distance blast banger and explosives formulation art. Furthermore, the long-distance blast banger of the present invention effectuates a high-decibel explosive sound, which will not endanger aircraft or personnel.

(b) Description of the Prior Art

Accordingly, no matter whether public or military airfields, in order to avoid noise generated from aircraft taking off and landing affecting residents, majority of airports are located at some considerable distance from residential districts. Furthermore, taking into account extensive grassland and remoteness from interference of a multitude of people of hinterland of the airport itself (and thereby suitable for sustaining flying insects) makes the airport an ideal location for birds to flock together and forage for food, as well as attracting wild dogs and rodents including rabbits, rats, and so on, to intrude within extent of the airport to forage for food.

In addition, because of intrusion of flocks of birds, and other wild animals, which control personnel are unable to restrain, as well as uncertainty of time and place the birds and other wild animals will appear, normal take off and landing of aircraft are greatly effected, and more seriously, can result in severe flight accident casualties. Therefore, flight safety divisions of countries worldwide are invariably at task to devising methods that effectively disperse the flocks of birds or animals. Among the methods employed, one method includes use of a shotgun to directly shoot at and thereby drive out the birds or wild dogs. However, such a method would not only directly cause injury to the animals, but is also inhumane. Moreover, projectiles fired from the shotgun will possibly result in damage to aircraft, and thereupon induce flight accidents of even greater magnitude.

Hence, a section of flight safety personnel utilize an explosive blast generated from firing blank ammunition to produce a deterrent effect and thereby deter flocks of birds from intruding within vicinity of the airport, while expecting to realize reduction in damage or injury to aircraft and personnel. However, because the flocks of birds intruding within the vicinity of the airport are flying at a considerable height, thus the explosive blast generated from firing the blank ammunition is unable actualize any great effect in practice on the flocks of birds in flight, and thereby cannot effectively resolve dispersing of the flocks of birds, moreover does not deal with question of endangerment to aircraft and personnel.

SUMMARY OF THE INVENTION

A long-distance blast banger of the present invention comprises a cartridge loaded with a banger assembly made of plastic material, wherein the banger assembly includes a sound explosives cup loaded with a sound explosives formulation, and a delay cup loaded with a delay formulation. At least two helical grooves extending from a bottom to a top of the cartridge are defined on an inner wall of the cartridge, and ear attachments are configured on a base of an outer wall of the balst banger so as to correspond with the helical grooves, thereby engendering a spinning stability effect during flight time of the banger assembly, and reducing wind resistance coefficient, while further coordinating with a propellent action of the delay formulation to actualize a significant increase in flight range of the banger assembly.

More particularly, the long-distance blast banger utilizes the adjustment of the delay formulation to modulate the flight range of the banger assembly, furthermore, since the delay cup is made of plastic materials, during the flying time of ignition of the delay formulation, the delay cup is melting and breaking apart, and formation of large fragments is averted.

In addition, the sound explosives cup is loaded with a sound explosives formulation having components including perchloryl potassium, magnesium powder and aluminum powder. A sufficient sound value is acquired through appropriate compactness of the sound explosives cup, and therefrom realizes uniform shattering of the cup into small fragments that are insufficient to cause injury. The long-distance blast banger thus achieves a long flight range, and generates a large shock force, while averting damage or injury to aircraft or personnel.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
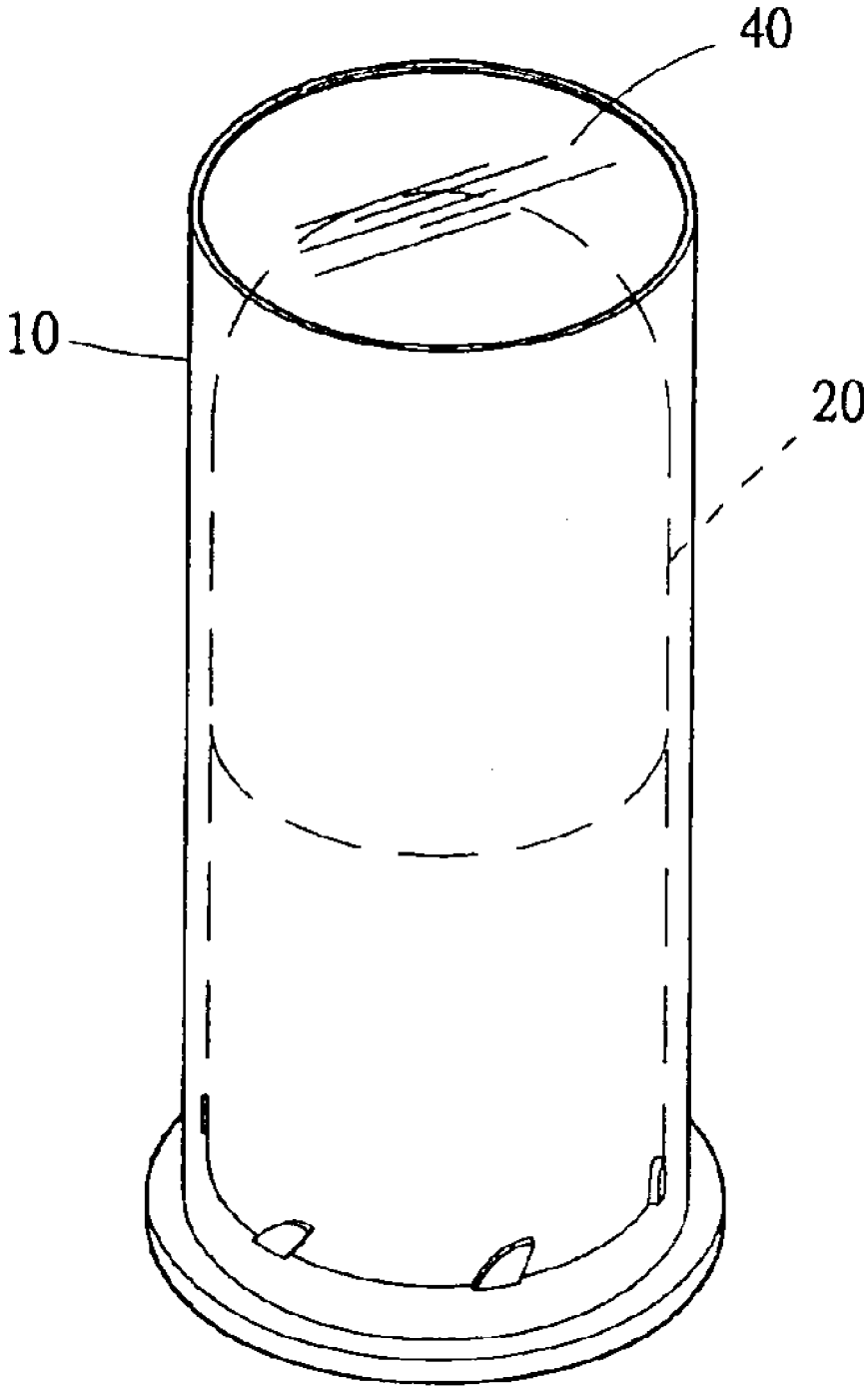
FIG. 1 shows a schematic elevational view of a long-distance blast banger according to the present invention.

In order to clearly describe structure, configuration and integral method of employment of the present invention, a description accompanied by drawings is disclosed hereinafter:

Referring to FIG. 1, which depicts a basic structure of a long-distance blast banger of the present invention comprising a cartridge 10 loaded with a blast banger 20 made up from plastic material. A seal lamella 40 further seals the blast banger 20 within the cartridge 10.

Figure 2:
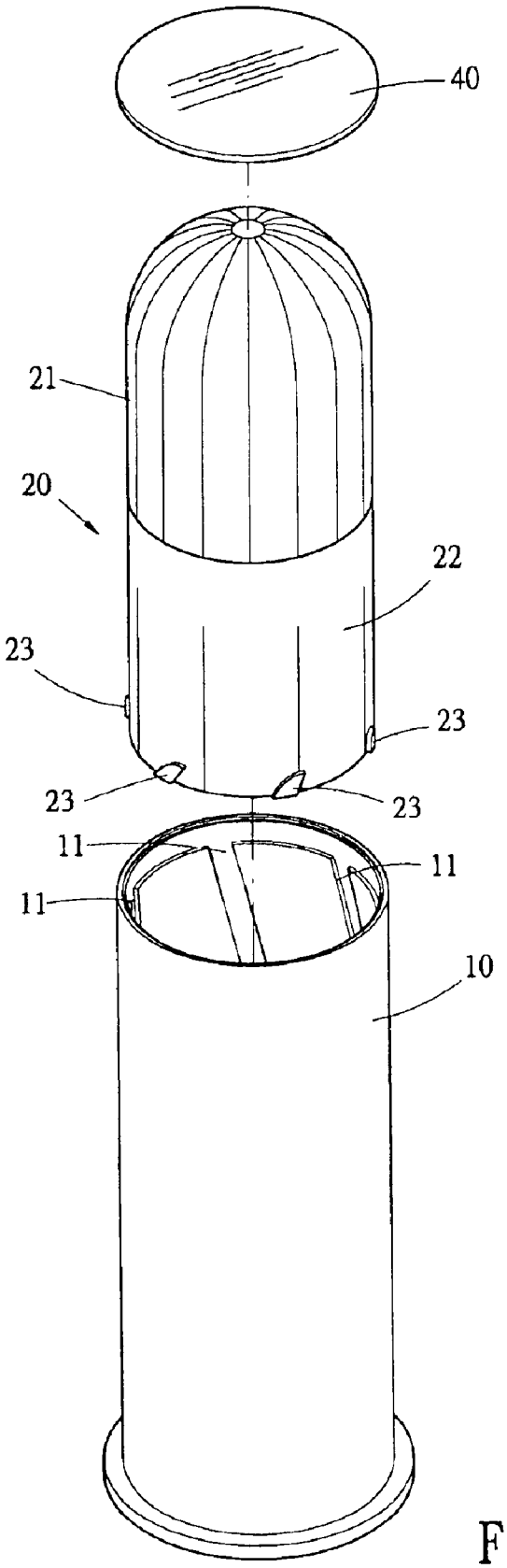
FIG. 2 shows an exploded view of a banger assembly according to the present invention.
Figure 3:
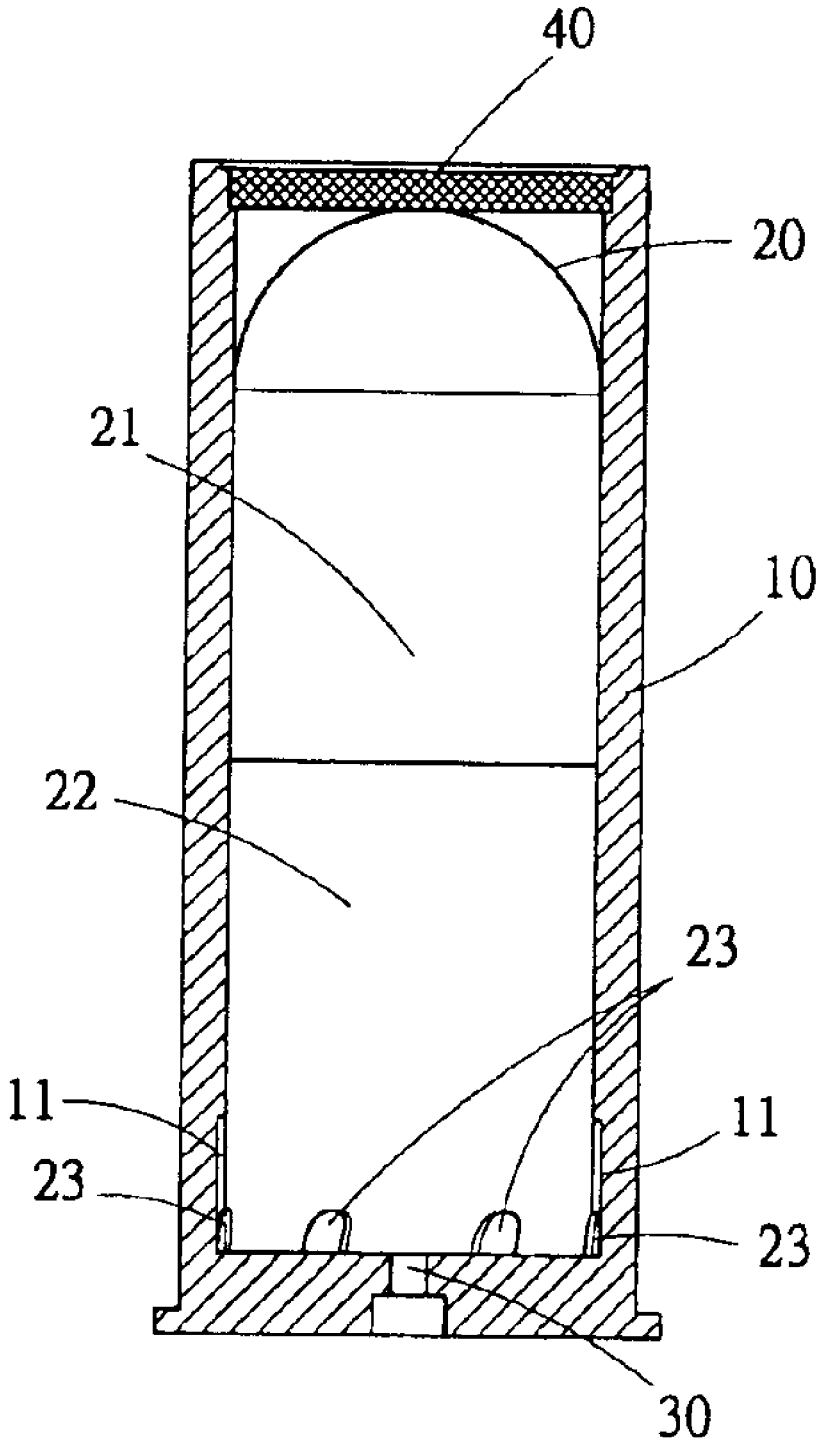
FIG. 3 shows a cross sectional view of a banger assembly according to the present invention.

With reference to FIGS. 2 and 3, which show the blast banger 20 encompassing a sound explosives cup 21 loaded with a sound explosives agent, and a delay cup 22 loaded with a delay formulation. Furthermore, a percussion primer 30 is configured in a bottom of the cartridge 10, which is utilized to ignite the delay explosives agent. At least two helical grooves 11 extending from the bottom to a top of the cartridge 10 are defined on an inner wall of the cartridge 10, and ear attachments 23 are configured on a base of an outer wall of the blast banger 20 so as to correspond with the helical grooves 11, thereby engendering a spinning stability effect during flight time of the blast banger 20, reducing wind resistance coefficient, and coordinating with a propellent action of the delay formulation, thereby realizing a significant increase in flight range of the banger assembly 20.

The sound explosives agent is formulated to include perchloryl potassium ($KClO_3$), magnesium powder (Mg), and aluminum powder (Al). A preferred percentage by weight of each component is 40–50% of perchloryl potassium, 35–50% of magnesium powder, and 0–10% of aluminum powder. An adequate sound value is acquired through appropriate compacting of the sound explosives cup 21, as well as effectuating uniform shattering of the cup 21 into small fragments that are insufficient to cause injury.

According to the long-distance blast banger of the present invention, characterized in realizing a long flight range, and generating a large shock force, while averting damage or injury to aircraft or personnel, a showpiece entity of the present invention was constructed according to the aforementioned disclosures, wherewith an actual test-launch was carried out over a flight range exceeding 300 meters, and results attained showed a sound reading of over 125 dB measured at a distance of over 30 meters from point of detonation, and plastic fragments resulting from the explosion were all below 0.3 grams in weight. The sound value of the immense sonic boom was sufficient to actualize dispersing of flocks of birds from vicinity of the airport; moreover, resulting fragments from the explosion had minimum effect on aircraft. The long-distance blast banger of the present invention is provided with a high safety aspect, and can even be employed in combat simulation training exercises, whereby the sonic boom is utilized for training personnel to experience battlefield conditions. In addition, the long-distance blast banger can be employed in naval defenses, and in riot control dispersal tactics. The flight range and energy of the small fragments is low, and thus will not cause injury to personnel.

In conclusion, the long-distance blast banger of the present invention provides a high-decibel explosive sound, which will not endanger aircraft or personnel, accordingly a patent application is proposed herein.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A long-distance blast banger structure comprising: a cartridge loaded with a blast banger made of a plastic material, the blast banger has a sound explosives cup loaded with a sound explosives agent, and a delay cup loaded with delay explosives, the cartridge has at least two helical grooves extending from a bottom to a top of an inner wall of the cartridge, the blast banger has ear attachments located on a base of an outer wall thereof corresponding with the at least two helical grooves, thereby engendering a spinning stability effect during flight time of the blast banger, and reducing wind resistance coefficient, while further coordinating with a propellent action of the delay explosives to actualize a significant increase in flight range of the blast banger.

2. The long-distance blast banger structure according to claim 1, wherein a percussion primer is located in a bottom of the cartridge, which is utilized to ignite the delay formulation.

* * * * *